US009751348B2

(12) United States Patent
Felip Aragon et al.

(10) Patent No.: US 9,751,348 B2
(45) Date of Patent: Sep. 5, 2017

(54) DETECTING AN ACCESSORY

(71) Applicant: HEWLETT-PACKARD DEVELOPMENT COMPANY, L.P., Houston, TX (US)

(72) Inventors: Carlos Felip Aragon, Barcelona (ES); Xavier Domingo Requant, Barcelona (ES); Raimon Castells de Monet, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/109,794

(22) PCT Filed: Jan. 31, 2014

(86) PCT No.: PCT/EP2014/051951
§ 371 (c)(1),
(2) Date: Jul. 5, 2016

(87) PCT Pub. No.: WO2015/113631
PCT Pub. Date: Aug. 6, 2015

(65) Prior Publication Data

US 2016/0325571 A1 Nov. 10, 2016

(51) Int. Cl.
*B41J 29/393* (2006.01)
*B41J 29/38* (2006.01)
(Continued)

(52) U.S. Cl.
CPC ..... *B41J 29/38* (2013.01); *B41J 2/01* (2013.01); *B41J 3/407* (2013.01); *B41J 11/0065* (2013.01)

(58) Field of Classification Search
CPC ..... B41J 29/393; B41J 11/0095; B41J 29/38; B41J 2/01; B41J 11/0065; B41J 3/4078; B41J 3/4075; B41J 3/407
(Continued)

(56) References Cited

U.S. PATENT DOCUMENTS 6,827,414 B2 12/2004 Iwatsuki et al.
8,020,957 B2 9/2011 Kayanaka
(Continued)

FOREIGN PATENT DOCUMENTS

CN 101376303 A 3/2009
CN 103153633 A 6/2013

OTHER PUBLICATIONS

ESC Europa. ESC-DTG M-Series Digital Textile Printing. http://www.esc-online.de/en/products/digital-printing/assets/esc_dtg_m_serie_mailversion_e.pdf.

*Primary Examiner* — Jannelle M Lebron
(74) *Attorney, Agent, or Firm* — HP Inc.-Patent Department

(57) ABSTRACT

A method for detecting a demountable accessory in an image-forming device is disclosed. The image-forming device comprises a controller, a print platen suitable for receiving a substrate, and a handling mechanism. The print platen has an optical sensor associated therewith adapted to capture an image of an item on the print platen. A first image is captured. The handling mechanism carries out an adjustment action suitable for adjusting the position of the substrate on the print platen. A second image is captured. The first and second images are analyzed to identify any changes and of the captured images is analyzed to detect an accessory identifier. The presence of an item on the platen is determined from the analysis.

15 Claims, 7 Drawing Sheets

(51) Int. Cl.

| | |
|---|---|
| ***B41J 3/407*** | (2006.01) |
| ***B41J 11/00*** | (2006.01) |
| ***B41J 2/01*** | (2006.01) |

(58) Field of Classification Search
USPC ..... 347/9, 14, 16, 19, 104
See application file for complete search history.

(56) References Cited

U.S. PATENT DOCUMENTS

| | | | |
|---|---|---|---|
| 2005/0024413 | A1 | 2/2005 | Ruiz et al. |
| 2011/0074855 | A1 | 3/2011 | Casaldaliga et al. |
| 2013/0008333 | A1 | 1/2013 | Peter et al. |
| 2013/0016368 | A1 | 1/2013 | Bouverie et al. |

DETECTING AN ACCESSORY

Image-forming devices for printing on a wide variety of printing substrates are well known. Certain image-forming devices may be able print on a variety of substrates, for example, by varying parameters such as ink quantity, drying and/or curing temperatures, substrate tension, and the like. Certain other image-forming devices may allow a physical accessory to be installed to allow certain substrates to be printed on. Such accessories may, for example, by used to prevent ink passing through the substrate to the print platen, and prevent vertical banding in a formed image due to the platen used.

DETAILED DESCRIPTION

If certain substrates are to be printed on, this may trigger the installation of a suitable accessory on the image-forming device. The accessory may be removed again when work on that type of substrate is completed. As such, the accessory may be referred to as a demountable accessory. Improved operation of an image-forming device that can accept a demountable accessory or one of a number of demountable accessories may be provided by a method of automatically detecting and classifying an item on the print platen.

When an accessory is installed, it may be necessary to alter the configuration of the image-forming device. It may be necessary to modify the parameters discussed above such as the ink quantity, however it may also be necessary to modify other parameters such as carriage beam distance to the substrate. If the incorrect distance is used, there could be an impact between the carriage and the accessory, which may cause damage to some or all of the parts involved. This may be particularly relevant in image-forming devices having heavy carriages, such as larger image-forming devices like industrial or production printers. Suitable methods for achieving this form the foundation of the present disclosure.

Figure 1:
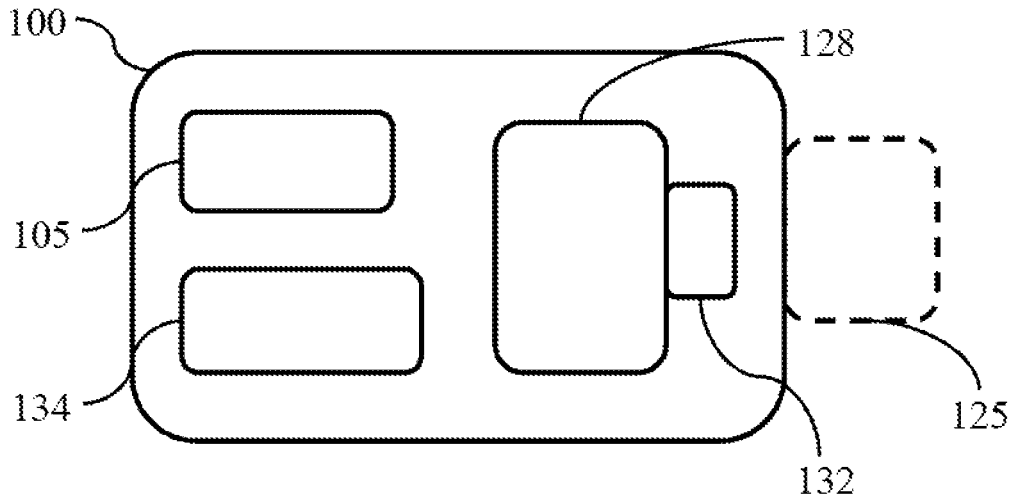
FIG. 1 is a block diagram of an image-forming device according to one example.

An example of an image-forming device capable of accepting a demountable accessory is shown in a block diagram in FIG. 1. An image-forming device 100 may comprise a controller 105, for controlling the operation of the image-forming device; a handling mechanism 134 for controlling the movement of the substrate through the image-forming device; and a print platen 128 for receiving the substrate onto which an image will be formed. The image forming device may further comprise a demountable accessory 125 (shown in phantom). A particular type of print job may indicate that a certain specified accessory should be installed before printing that job.

The print platen 128 has an optical sensor 132 associated therewith. The optical sensor 132 is located such that it can capture an image of an item located on the print platen 128. The handling mechanism may comprise a number of rollers for moving the substrate, and may be able to move the substrate in forward and reverse directions.

Figure 2:
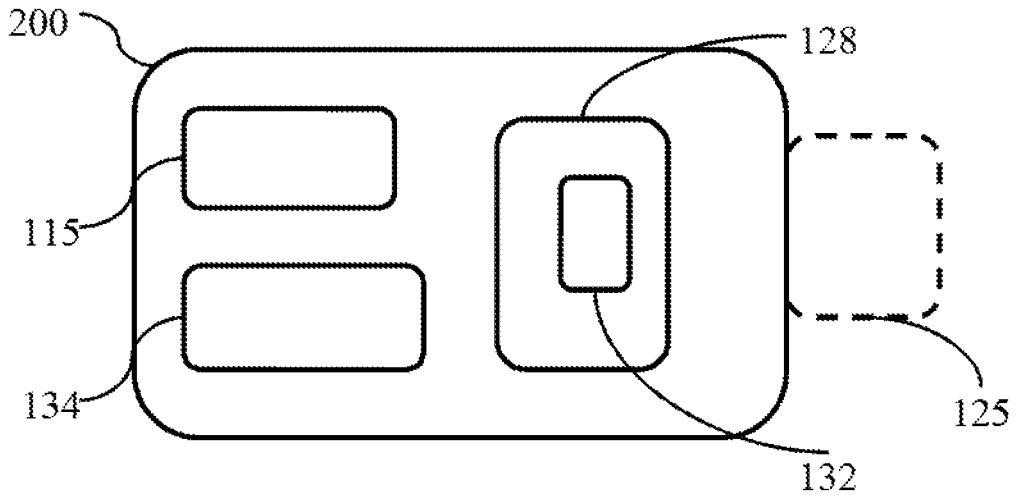
FIG. 2 is a block diagram of another image-forming device according to one example.

FIG. 2 shows another example of an image-forming device capable of accepting a demountable accessory. In this example, an image-forming device 200 is similar to that shown in FIG. 1 except that the optical sensor is located in the print platen.

The example image-forming devices may include components in addition to those illustrated in the figures.

Figure 3:
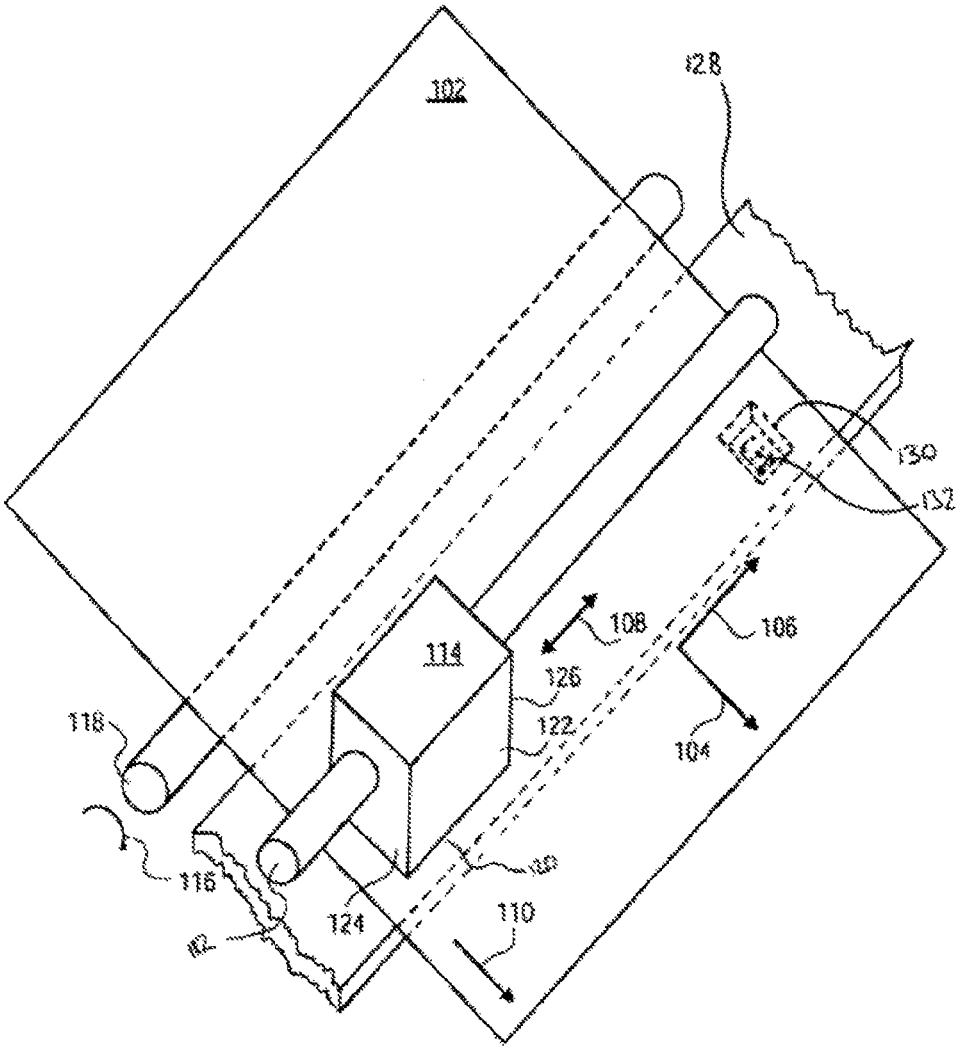
FIG. 3 is a schematic, perspective view of an image-forming device which may make use of the present disclosure according to one example.

FIG. 3 shows a perspective view of an example implementation of the example shown in FIG. 2. The device includes a shaft 112 on which a scanning carriage, 114 is slidably situated. The scanning carriage scanning carriage 114 has a left side 124, a right side 126, a front 122, and a bottom 120. The scanning carriage 114 supports one or more printing heads (not shown), which may be inkjet print-heads. The scanning carriage 114 is able to move back and forth along a scanning axis 106, as indicated by the bi-directional arrow 108. As the mechanism moves back and forth, the print-heads may be controlled to eject ink on a substrate 102 located beneath the scanning carriage 114. The substrate 182 is advanced by a roller 118, part of the handling mechanism. The roller 118 may rotate in the direction indicated by the arrow 116. This causes the substrate 102 to move along a media axis 104 that is perpendicular to the scanning axis 106, as indicated by the arrow 110.

As can be seen from the figure, the substrate 182 is supported by a print platen 128 in the region where the substrate receives ink from the print-heads. The print platen 128 has an opening 130 passing through its thickness, having the optical sensor 132 located therein. The optical sensor 132 is located such that it is able to sense or image the underside of the substrate 102, which is resting on top of the platen 128, through the opening 130 in the platen. In practise, the optical sensor 132 may be located in any convenient location; for example: in a recess in the upper surface of the platen; or, above the platen and the print media. In any event, however, it is preferable that the media-positioning sensor 132 does not obstruct the advance of the substrate. The image-forming device may further comprise an illumination source to provide suitable illumination to allow the optical sensor to capture require images. The illumination sound may comprise four sets of LEDs (not shown), each set referred to as a quadrant, with two quadrants on each side of the optical axis of the sensor. The optical sensor 132 may be any suitable optical sensor, such as a charge-coupled device (CCD) sensor, a complementary metal-oxide semiconductor (CMOS) sensor, or another type of optical sensor.

Figure 4:
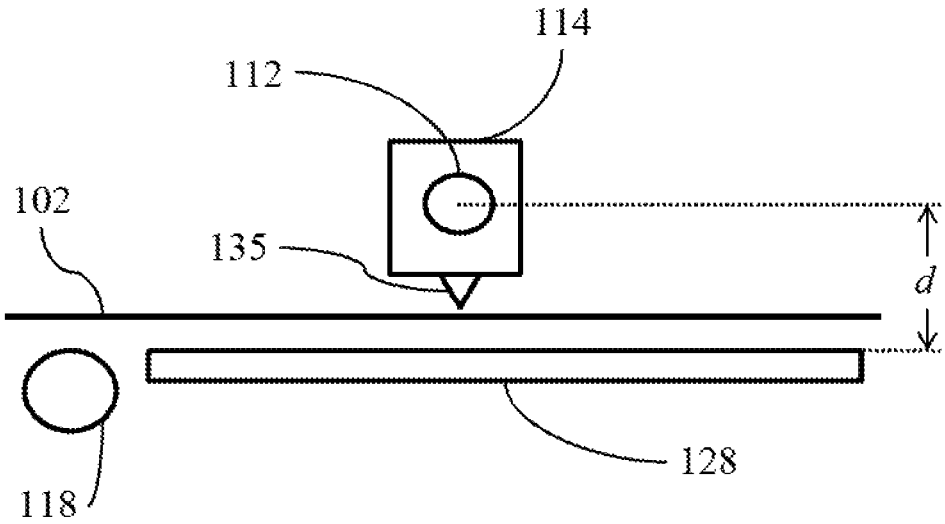
FIG. 4 is a representation of a side view of the image-forming device shown in FIG. 3.

FIG. 4 shows a side view of the example implementation shown in FIG. 3. In FIG. 4, the print-head 135 can be seen, protruding from the bottom of the scanning carriage 114. A distance d between the top of the print platen 128 and the centre of the shaft 112 of the scanning carriage 114 is illustrated.

Figure 5:
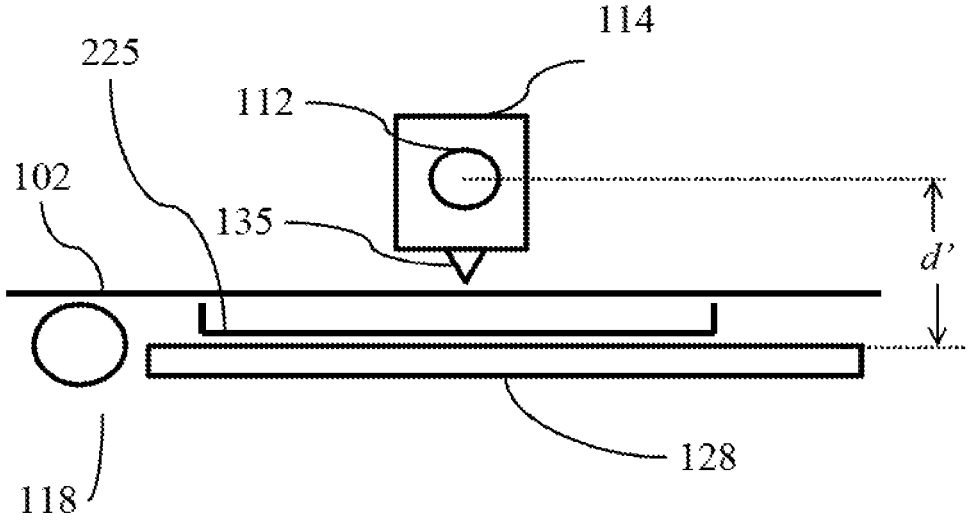
FIG. 5 is a representation of a side view of an image-forming device having an accessory fitted, according to one example.

FIG. 5 shows a side view of the implementation shown in FIG. 4, however, here a demountable accessory 225 has been installed in the image-forming device such that it is resting on the print platen 128. A distance d' between the top of the print platen 128 and the centre of the shaft 112 of the scanning carriage 114 is illustrated, wherein the distance d' is larger than distance d of FIG. 4. The distance d' may be up to 120 mm.

In practice, in FIGS. 4 and 5, the substrate 102 may be resting on the print platen 128, or the demountable accessory 225, and the roller 118, however for clarity of illustration, they are shown as slightly separated.

Figure 6:
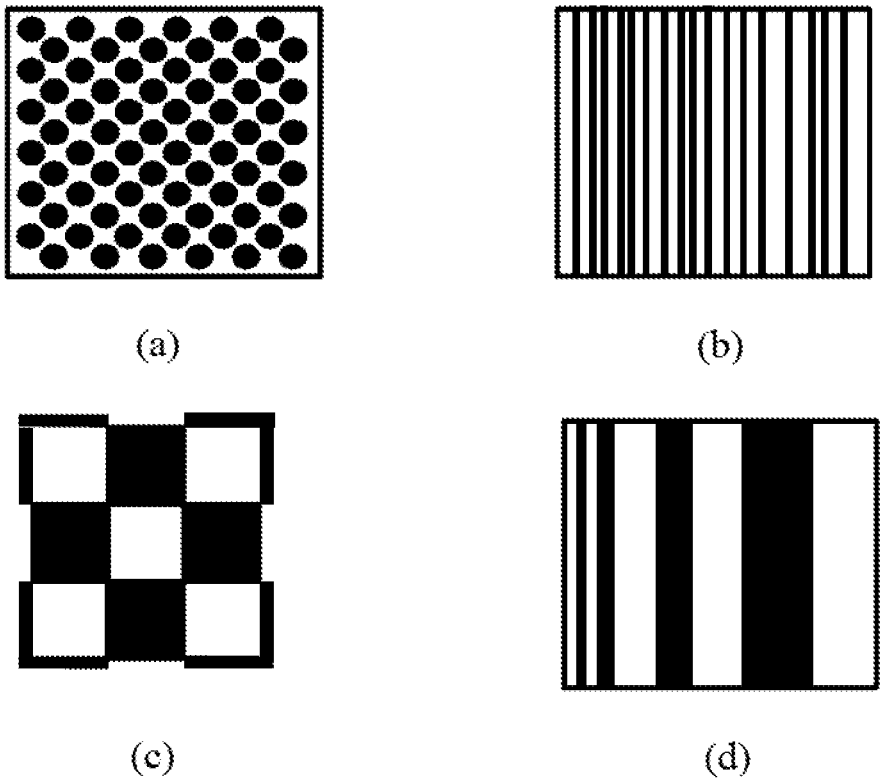
FIGS. 6(*a*) to (*d*) are examples of accessory identifiers.

Each demountable accessory may be marked with an accessory identifier, positioned on the accessory such that the accessory identifier will be located within the field of view of the optical sensor when the accessory is correctly installed in the image forming device. A selection a of large number of possible accessory identifiers are shown in FIG. 6, with FIG. 6(*a*) showing a pattern of spaced apart black dots; FIG. 6(*b*) showing spaced apart lines of uniform thickness with variable distances therebetween; FIG. 6(*c*) showing a square formed from a 3×3 arrangement of smaller squares and with a partial border at the corners, the smaller squares having a mark-space arrangement forming a cruciform shape; and FIG. 6(*d*) shows a series of black lines, with increased thicknesses and increasing spaces therebetween. A wide variety of similar style patterns may be used. Additionally, other patterns, images or characters may also be used. An accessory identifier may be assigned to each type of accessory, each version of an accessory and so on.

Figure 7:
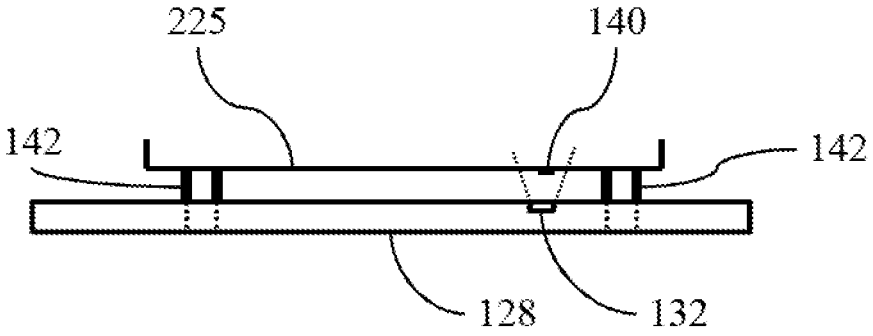
FIG. 7 is a side view of an accessory fitted on a print platen, according to one example.

FIG. 7 shows a side view of a demountable accessory 255 fitted on a print platen 128 such that the accessory identifier 140 is located in the field of view of the optical sensor 132, which field of view is indicated in broken lines. The accessory identifier 140 may take the form of a label affixed to the accessory 225, be printed directly on the accessory 225 or otherwise marked thereon. The demountable accessory 225 is shown provided with a set of supports 142 for engagement with suitable apertures (not shown) in the print platen 128. As such, by inserting the supports into the correct apertures in the print platen, the demountable accessory may be correctly located on the print platen, to provide for its effective use with respect to the optical sensor, and is fixed in place until it is to be removed. The supports and apertures may be formed in a 'pokayoke' manner so as to facilitate fitting the accessory in the correct location and orientation.

Figure 8:
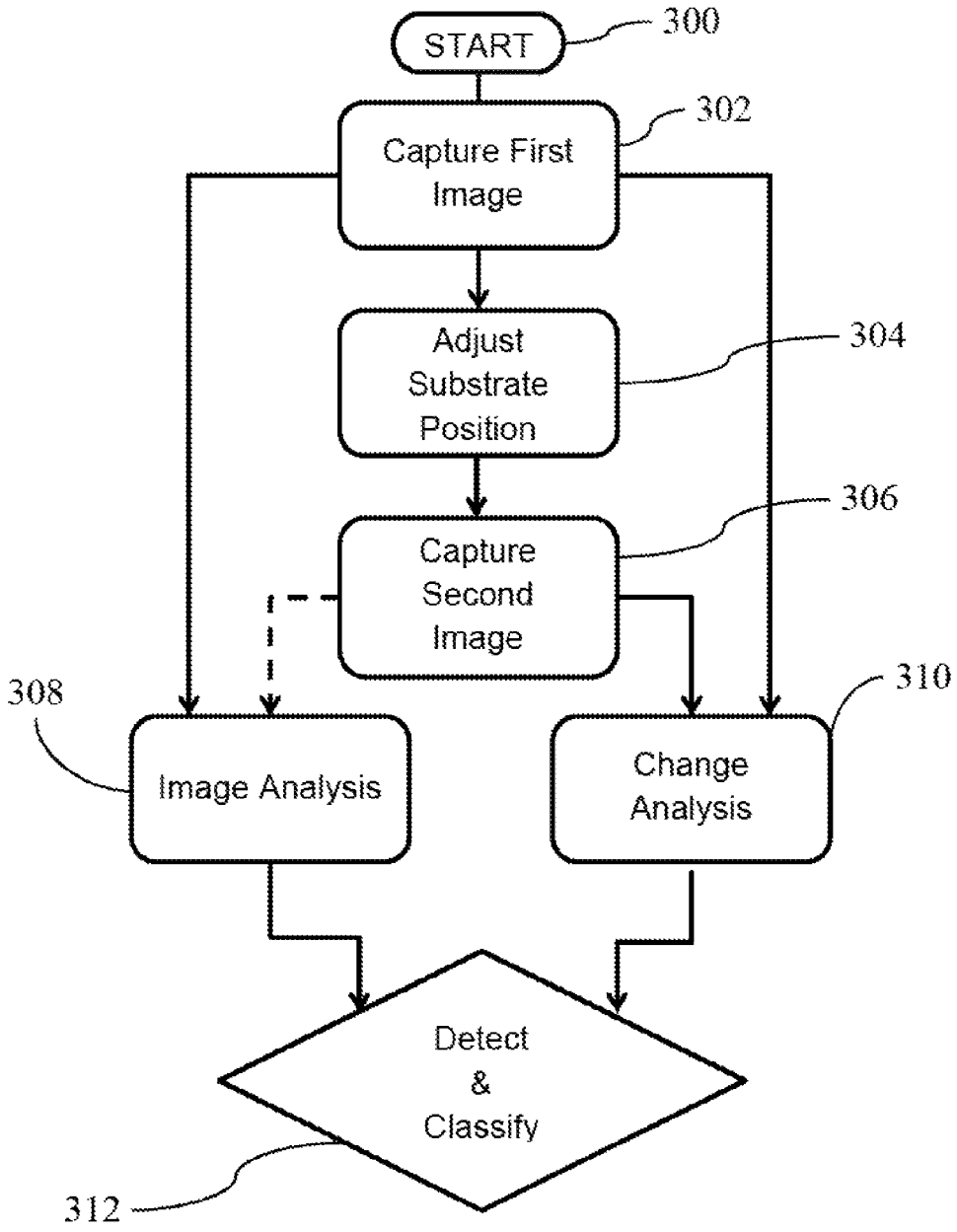
FIG. 8 is a flowchart of a method according to one example.

FIG. 8 shows a flow chart of an example method for use in an image-forming device as described herein. The method starts at block 300 and at block 302 a first image is captured by the optical sensor. Next, at block 304, the handling mechanism 134 may carry out an adjustment action, which is suitable for adjusting the position of a substrate. The adjustment action may be such that the position of the substrate, if present, on the print platen 128 would be adjusted. This may involve turning one or more rollers of the handling mechanism 134. The adjustment action may be an advancing adjustment, such that a substrate would move forward on the print platen. The adjustment action may be a reversing adjustment, such that a substrate would move backward on the print platen. The adjustment action may be an action to modify the angle or skew of a substrate. The adjustment action may comprise a combination of those actions previously mentioned and other adjustment actions may be envisaged. It is not necessary for a substrate 102 to be in place for this adjustment action by the handling mechanism take place. The adjustment may be of a small distance such that the portion of the substrate that would have been within the field of view of the optical sensor for the first image overlaps with the portion of the substrate that would be in the field of view after the adjustment action. A handling mechanism adjustment action that would result in a substrate movement of around 10 mm to 40 mm may be used. After the adjustment action by the handling mechanism, at block 306 the optical sensor may capture a second image. At block 308, image analysis may be parried out on at least one of the captured images. The image analysis may comprise identifying the presence of an accessory identifier and classifying the accessory identifier in question. At block 310, the first and second images may be analysed to detect any changes therebetween.

Analysing one of the captured images to detect an accessory identifier may be carried out using a bi-dimensional Fourier transform of the captured image. In this way, the analysis may be carried out in the frequency domain, and the detected frequencies may be matched to those corresponding to a defined accessory identifier pattern.

Analysing the first and second images to detect any changes therebetween may be carried out using a phase correlation analysis between the two images.

Figure 9:
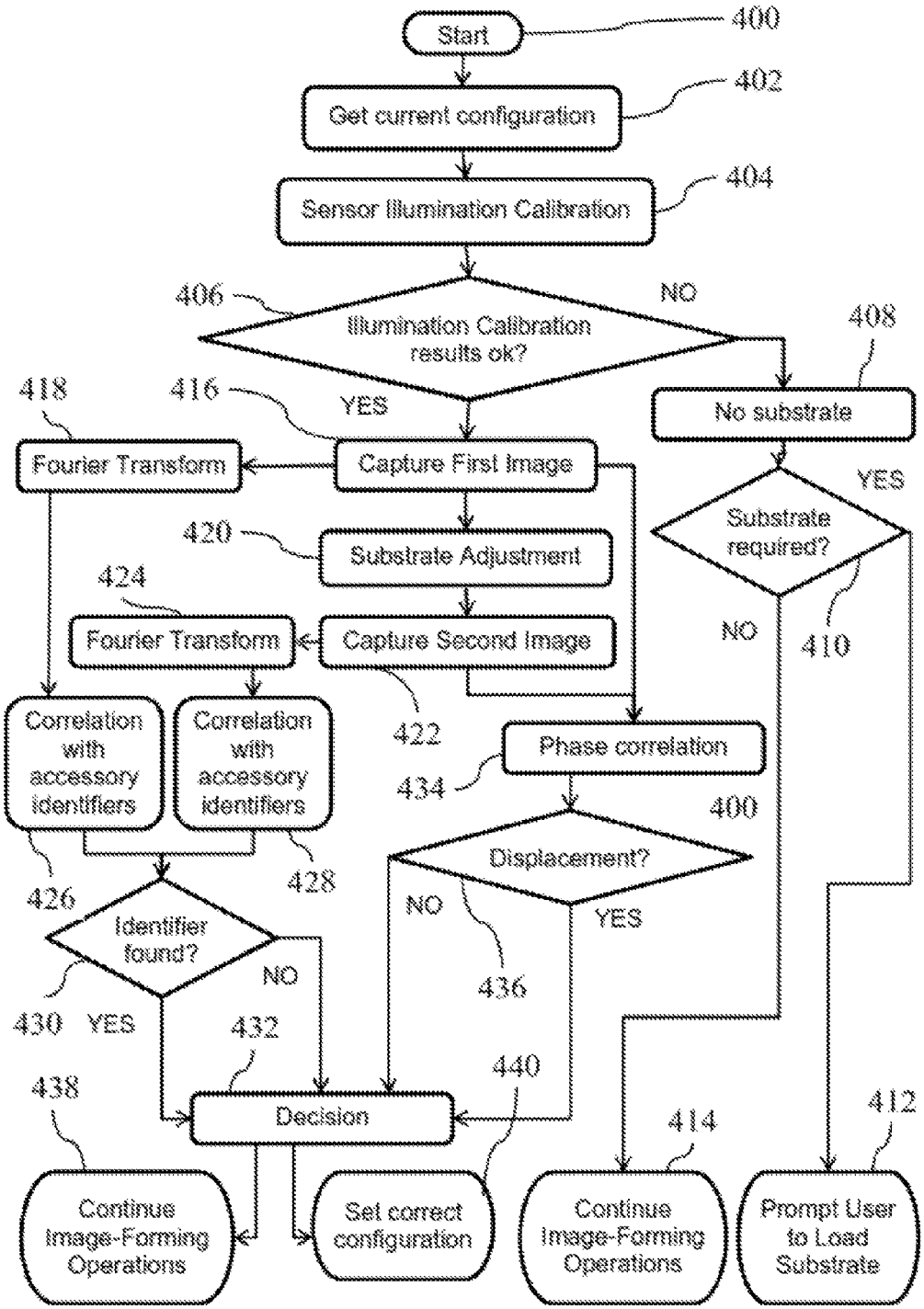
FIG. 9 is a flowchart of a method according to a more detailed example.

Referring now to FIG. 9, there is shown a flow chart of a more detailed example of the method described herein. The method begins at block 400, and at block 402 the current configuration of the image-forming device may be ascertained by the controller. At block 404, a calibration operation may be carried out on the illumination for the optical sensor. At block 406 the results of the calibration are checked. The calibration of the illumination for the optical sensor may be carried out by capturing a series of images illuminated under different conditions, for example by using different quadrants of LEDs and at different exposure times. The resulting images may be analysed to select a lighting arrangement that provides an average value of the image information between an upper and lower threshold.

If the calibration results are not acceptable, it may be deduced at block 408 that there is no substrate loaded into the image-forming device. If there is no substrate present, there is nothing to reflect the light from the illumination sources back to the optical sensor, resulting in poorly lit images. It is possible that such conditions could also arise if a fully transparent substrate was in place or if the sensor window was very dirty, however in practice these situations rarely occur.

At block 410, a check may be performed to see if a printing substrate is currently required. Certain operations, such as print head cleaning, may not require that a substrate be present and as such the lack of a substrate may not be obstacle to continuing the current task. At block 412, if no substrate is required for the task currently being undertaken, then the image-forming device may continue to carry out the task assigned to it at that time. If a substrate is required, then at block 412, the image-forming device may cease its current operations and prompt the user to load the required substrate.

If, at block 406, the results of the illumination calibration are checked and are found to be acceptable, the method may proceed to the optical sensor capturing a first image at 416. A bidirectional Fourier transform may be carried out on the first image at block 416. Then at block 420, the handling mechanism may carry out an adjustment action, which is suitable for adjusting the position of a substrate. The adjustment action may result in a small and precise adjustment of the position of the substrate on the print platen, for example in the range 10 mm to 40 mm.

After the adjustment action by the handling mechanism, the optical sensor may capture a second image at block 422, and a bidirectional Fourier transform of the second image may be carried out a block 424. Next, at block 426 for the first image, and at block 428 for the second image, a cross-correlation may be carried out with the Fourier transform of the captured images and the Fourier transform of the known accessory identifiers. In this way, the cross correlation may identify matches between the captured images and accessory identifiers. Whether or not an accessory identifier has been found through the cross-correlation operations may be evaluated at block 430, and the answers fed to the main decision block at block 432. Other image analysis techniques may be used, for example, those that facilitate pattern matching, object detection, character recognition or the like.

Returning to the first and second captured images, at block 434, a phase correlation may be carried out between the pair of captured images. This allows detection of any displacement between the first and second captured images at block 436, with the answer being fed to the main decision block at block 432. Other displacement detection techniques may be used.

There are two main possible outcomes from the main decision block. Firstly, if the calculated status of the image-forming device, with respect to substrate and accessories, corresponds with the current configuration, from block 402, of the image-forming device, then at block 438 no action is required, and the image-forming device may continue with its assigned task.

On the other hand, if at block 440, the calculated status of the image-forming device does not correspond with the current configuration, from block 402, of the image-forming device, then the correct configuration may be implemented automatically by the controller. Once the necessary configuration changes have been set, the image-forming device may then continue with its assigned task.

Figure 10:
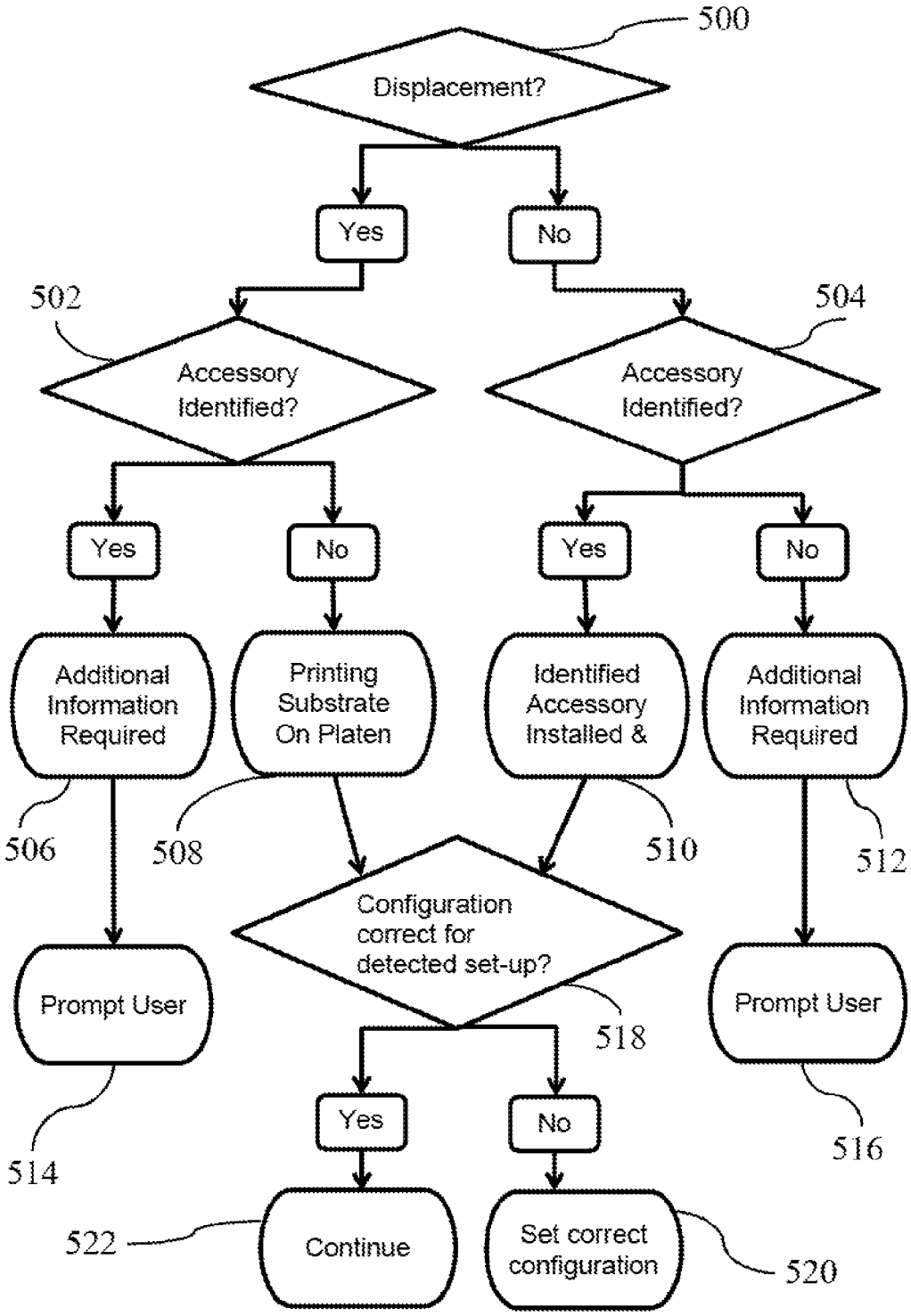
FIG. 10 is a flowchart of a categorisation process, according to one example.

FIG. 10 shows a decision tree for the main decision block of FIG. 9. Firstly, a check may be made if there has been any displacement between the first and second captured images at block 500. A displacement between these two images may indicate that an item is present on the print platen, as that item was moved by the adjustment action of the handling mechanism. Next, for each outcome at block 500, a check may be made for an identified accessory, at blocks 502 and 504. If a displacement has been detected and no accessory has been identified, then it may be decided, at block 506, that a substrate is present on the print platen. Movement of the substrate by the handling mechanism resulted in the detected displacement, and there is no evidence of the any accessory.

If it is decided that there was displacement but that an accessory was also identified, then at block 506 additional information may be required. If an accessory is present, it should be fixed in place and should not move when subjected to an adjustment action by the handling mechanism. As such displacement of an accessory indicates a potential issue, and at block 514 the user is prompted to rectify the situation.

If no displacement has been detected, and an accessory has been detected and identified, then, at block 510 it may be decided that the identified accessory is fitted and it ready for use.

If no displacement has been detected, and no accessory has been detected then at block 512 it may be decided that there may be neither a substrate nor an accessory in place. As such, further information may be requested from a client.

Other information may be deduced from the analysis of the captured images. For example, a set of images where some features indicate a displacement and some features indicate no displacement may indicate that the sensor optics are dirty and should be cleaned. In such a situation, the user may be prompted to carry out the necessary maintenance.

In both situations where the image-forming device is deemed to be ready to continue, the method may comprise accessing current configuration information for the image-forming device and accessing defined configuration information for the classified item, and setting the defined configuration information for the classified item as the current configuration information. If the current configuration information is already correct, no further action may be required.

An image-forming device operating the method disclosed herein may modify its configuration automatically to suit any fitted accessory; automatically restore standard configuration if an accessory is removed; and so on. Automatic detection and classification of an accessory and automatic modification to the configuration information may reduce human error in the use of accessories with the image-forming device, which may in turn lead to increased safety, robustness and productivity. Providing for an image-forming device to always operate according to the defined configuration information for its set-up may prevent damage to the image-forming device, thus potentially reducing time spent off-line for maintenance and repairs. Automatic updates to the configuration information as required by the set-up save time for the user, speeding up the overall process.

If the image-forming device is operating under the correct configuration information, it can reduce or eliminate time-consuming safety steps that were previously implemented, such as slow movement of the carriage until it has been established that there are not accessories in place. Reducing such slow movement of the carriage may lead to an increase in through-put and productivity.

The method disclosed herein may be used when a substrate is loaded into the image-forming device, as that is a useful time to set the configuration information, or at other preparations stages before a print job is commenced. However, it may also be used at other times, for example before certain print-head maintenance tasks such as replacement, alignment or cleaning. The scanning carriage may move to a maintenance position for these tasks, and it is useful to ensure there is no accessory in the carriage's path before commencing, so as to reduce the risk of a collision. The method may also be used if a user has indicated that an accessory is present, to verify that everything has been correctly installed.

Configuration information may include ink quantity, curing time, curing temperature, scanning carriage height, printing speed, print mode, substrate tension and the like. Configuration information may also comprise other information, for example, information relating to parameters that are accessory or substrate dependent.

The term substrate has been used to include any medium suitable for printing. For example, the substrate may be paper, cardboard, vinyl, etc.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, described in conjunction with a particular aspect, implementation or example of the disclosure are to be understood to be applicable to any other aspect, implementation or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing examples. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method for detecting a demountable accessory in an image-forming device, the method comprising:

capturing a first image using an optical sensor associated with a print platen of the image-forming device, wherein the print platen is to receive a substrate and the optical sensor is to capture an image of an item on the print platen;

carrying out an adjustment action by a handling mechanism of the image-forming device, the adjustment action for adjusting a position of a substrate on the print platen;

capturing a second image by the optical sensor;

analyzing, using the controller, the first and second images to identify displacement;

analyzing, using the controller, at least one of the first image and the second image to detect an accessory identifier;

responsive to the analyzing, determining the presence of an accessory and classifying the accessory based on the detected accessory identifier.

2. The method of claim 1, comprising capturing an image of an underside of an item on the print platen using the optical sensor.

3. The method of claim 1 further comprising:

accessing, using the controller, current configuration information for the image-forming device;

accessing, using the controller, defined configuration information for the classified accessory; and setting the current configuration information to the defined configuration information.

4. The method of claim 1, wherein the adjustment action is for adjusting the position of the substrate on the print platen by 10 mm to 40 mm.

5. The method of claim 1 comprising carrying out an advancing adjustment action, a reversing adjustment action, or a combination thereof, using the handling mechanism.

6. An image-forming device comprising:

a controller;

a print platen suitable for receiving a substrate; and a handling mechanism to maneuver a substrate received on the print platen;

wherein the print platen comprises an optical sensor to capture at least a pair of images of an item received on the print platen;

and further wherein the controller is to:

trigger the capture of the at least the pair of images;

trigger an adjustment action, by the handling mechanism, to adjust a position of the substrate on the print platen; and identify the presence of a demountable accessory based on an identified accessory identifier in the captured at least the pair of images.

7. The image-forming device of claim 6, wherein the optical sensor is located in the print platen to capture an image of an underside of an item on the print platen.

8. The image-forming device of claim 6, wherein the adjustment action is to adjust the position of the substrate by 10 mm to 40 mm.

9. The image-forming device of claim 6, wherein the controller is to:

access current configuration information for the image-forming device and defined configuration information for the demountable accessory; and set the defined configuration information for the demountable accessory as the current configuration information for the image-forming device.

10. The image-forming device of claim 6 wherein the adjustment action comprises an advancing adjustment action, a reversing adjustment action, or a combination thereof.

11. A non-transitory machine-readable storage medium encoded with instructions executable by a controller that when executed cause the controller to:

capture, using an optical sensor associated with a print platen in an image-forming device, a first image of an item on the print platen;

carry out an adjustment action, using a handling mechanism of the image-forming device, wherein the adjustment action is to adjust a position of a substrate on the print platen;

capture a second image using the optical sensor;

analyze the first image and the second image to identify displacement;

analyze at least one of the first image and the second image to detect an accessory identifier;

process the results of the analysis to determine the presence of an accessory on the print platen and to classify the accessory based on the detected accessory identifier.

12. The non-transitory machine-readable storage medium of claim 11 further comprising instructions that when executed cause the controller to capture an image of an underside of an item, using the optical sensor.

13. The non-transitory machine-readable storage medium of claim 11 further comprising instructions that when executed cause the controller to:

access current configuration information for the image-forming device;

access defined configuration information for the classified accessory; and set the current configuration information to the defined configuration information.

14. The non-transitory machine-readable storage medium of claim 11 further comprising instructions that when executed cause the controller to carry out an adjustment action, using the handling mechanism, to adjust the position of the substrate on the print platen by a distance between 10 mm and 40 mm.

15. The non-transitory machine-readable storage medium of claim 11 further comprising instructions that when executed cause the controller to carry out an advancing adjustment action, a reversing adjustment action, or a combination thereof, using the handling mechanism.

* * * * *